US005629868A

United States Patent [19]

Tessier et al.

[11] Patent Number: 5,629,868

[45] Date of Patent: May 13, 1997

[54] METHOD OF PROGRAMMING LOCAL CONTROL

[75] Inventors: Alain Tessier, Piedmont; Alain Cartier, Pierrefonds; Michel Beaudry; Geneviéve Ayotte, both of Montreal, all of Canada

[73] Assignee: Le Groupe Vidéotron Ltée, Montreal, Canada

[21] Appl. No.: 193,413

[22] Filed: Feb. 7, 1994

[51] Int. Cl.[6] ..... G08B 1/08

[52] U.S. Cl. ..... 364/514 R; 348/164

[58] Field of Search ..... 348/764, 164; 380/10; 359/142, 145, 146, 172, 181; 340/825.72, 825.82, 825.83; 364/514 R

[56] References Cited

U.S. PATENT DOCUMENTS 5,228,077 7/1993 Darbee .
5,229,763 7/1993 Nakamara ..... 340/825.72
5,287,210 2/1994 Sefidvash ..... 359/147
5,297,204 3/1994 Levine ..... 380/10
5,410,326 4/1995 Goldstein ..... 348/734

*Primary Examiner*—Emanuel T. Voeltz
*Assistant Examiner*—Thomas Peeso
*Attorney, Agent, or Firm*—Pascal & Associates

[57] ABSTRACT

This invention relates to programming a remote control comprised of storing in a memory, data for control of a population of appliances, the data being sufficient to allow a remote control to remotely control functions of any of the population of appliances; selecting which appliances are to be controlled by the remote control; transmitting to the remote control data for control of the selected appliances; storing the transmitted data in the remote control; whereby the remote control is programmed to control the selected appliances.

28 Claims, 2 Drawing Sheets

METHOD OF PROGRAMMING LOCAL CONTROL

FIELD OF THE INVENTION

This invention relates to learning remote controls and particularly to a method of automatically programming such remote controls as a television remote control.

BACKGROUND TO THE INVENTION

Remote controllers for various appliances were originally wired to the appliances, such as a remote control for a television set or VCR. Eventually remote controls became wireless, a very popular mode of operation using infrared electromagnetic energy emitted from the remote control to an infrared receiver connected to a television converter, a television set or a VCR.

With the proliferation of additional types of appliances in a home such as video cassette recorders (VCRs), video disc players, and several television sets, each of which usually requiring a different code, a different dedicated remote control is required to control each appliance. In order to avoid a proliferation of remote controls, learning remote controls were invented. A single learning remote control typically stores; control sequences for controlling various appliances. Two patents which describe learning remote controls are U.S. Pat. No. 4,802,114 issued Jan. 31st, 1989 and U.S. Pat. No. 4,623,88?issued Nov. 18th, 1986.

In order to program a learning remote control, a dedicated remote control is positioned nose-to-nose (spaced a short distance) with the learning remote control. The learning remote control is placed in a learning mode, certain switches are operated in order to establish a memory location dedicated to storing data relating to particular functions, and the dedicated remote control corresponding switch is operated. As a result infrared data signals are transmitted from the dedicated remote control to the learning remote control whereby the data sequence is received and stored. The stored data can be accessed by a switch dedicated to a particular function, and the stored corresponding control sequence is transmitted via infrared energy to the appliance to be controlled, in place of the dedicated remote control. This function is repeated for each of the control keys for which the learning remote control is to be used. The data sequences for several different appliances can be stored associated with keys dedicated to the various appliances.

It has been found that the process for teaching the remote control the various sequences is tedious, has been difficult to learn to perform properly, and indeed cannot be followed properly by some people. This results in the storage of incorrect data or no data in the learning remote control, and thus it cannot be used to properly control the appliances. For this reason other techniques for storing a program for invoking specialized functions have been tried, such as the use of dedicated number sequences published in popular media such as newspapers, to allow a user to key in those number sequences from a remote control into e.g. a VCR, programming it. However this does not facilitate remote control of e.g. a TV set, channel changing, control of the on and off sequence or channel switching of a VCR, track switching on a video disc player, control of audio equipment, etc., and therefore is highly limited and is inherently specialized to only a very small group of functions, to the programming of a VCR.

One service provides storage of codes to control various VCRs etc. in the remote control, but the remote control must be sent to the manufacturer for updating and electrical storage of codes in RAM of the control unit. Storage is sufficiently complicated and technical that it cannot be done by the user. While the control unit is being sent away, the owner cannot use it, and there is risk of loss or damage when it is being sent away. This procedure must be done each time there is to be an update of the stored data. Clearly this is inconvenient and an objectionable procedure from the point of view of the user. See U.S. Pat. No. 4,959,810 issued Sep. 25th, 1990, invented by Paul V. Darbee et al.

Clearly previous techniques for teaching a remote control have been either difficult to impossible to use by some people, inconvenient or are inherent limited.

SUMMARY OF THE PRESENT INVENTION

The present invention provides automatic teaching of a remote control, without requiring a person to specifically teach it using dedicated remote controls. The remote control can be taught to retain the data codes for the control of any remote controllable apparatus. Indeed, the user need only select the appliances that are to be remote controlled from a menu displayed on a television screen. The menu can be expanded to include as many appliances as are being commercially sold. There is no need to program function key by function key which is required in the above-described prior art system, in which each key is required to be programmed.

Briefly, control codes for all expected appliances are transmitted cyclically from a head end and are broadcast repetitively and cyclically to all subscribers. The broadcast can be effected via any medium, e.g. local television station broadcast, satellite broadcast, cable TV, optical fiber, and could even be called up on demand by means of a telephone call.

The repetition rate can be as may be convenient, e.g. every television frame, every several seconds, etc.

The control codes define a list of appliances that are controllable as well as their control sequences, and are grabbed (captured) from the cyclical data, and are stored locally in a memory of a subscriber station. On demand, a menu showing the list of appliances is retrieved from the local memory and displayed on the display of a television set. The subscriber selects whichever is of interest from the list, and after entering a "teach" command to the remote control, which transmits the teach code to the subscriber station, the corresponding control sequences for that appliance are retrieved from the local memory and are transmitted to the remote control, e.g. by flashing a defined region such as a rectangle on the television screen in accordance with the control sequences corresponding to the selected appliance and its functions. The flashing on the television screen or other emitter (e.g. a light emitting diode on a decoder cabinet) is received by the remote control, translated into data, and is stored in its memory. Using a standardized remote control the stored data can also include address data which causes the control sequence data to be stored at remote control memory locations that are accessible by particular keys. That is, predesignated keys on the remote control can access data at predetermined address locations in the memory where particular control sequence data designated by the address data has been stored, thus allowing the remote controller to control various different appliances by means of particular common switches. For example different brands of VCRs can be controlled using the same standard control switches on the remote control for on-off, channel switching, time set, etc. Alternatively the control sequence data transmitted from the subscriber station can be all of the control sequences for all selected appliances, and can load the remote control memory from a predetermined memory location, and the remote control switches can access the required control sequences due to the serial memory address locations where the required control sequences are stored.

It is intended that the control sequence data can be in addition to or in substitution for control of various appliances, the control of a VCR or equivalent to turn on and record a program or programs at a particular time or times on a particular channel or channels.

Teaching of the remote control is thus easy and is virtually foolproof. The head end need merely add various remote control sequences to the data cyclically transmitted as additional remote controllable appliances are commercially sold. The data transmitted need not be limited to sequences for the control of television sets, VCRs, etc., but could include remote control sequences for audio systems, lighting control systems, burglar alarms, automatic telephone dialers, banking systems, game devices, home automation, programming of particular programs on a VCR, etc.

In accordance with an embodiment of the invention, a method of programming a remote control is comprised of storing in a memory, data for control of a population of appliances, the data being sufficient to allow a remote control to remotely control functions of any of the population of appliances; selecting which appliances are to be remotely controlled by the remote control, transmitting to the remote control data for control of the selected appliances, and storing transmitted data in the remote control; whereby the remote control is programmed to control the selected appliances.

In accordance with an other embodiment, a method of programming an appliance control apparatus is comprised of repetitively and cyclically transmitting control codes for a population of appliances from a central location, receiving the control codes and storing at least those control codes required to control local appliances at the control apparatus.

It should be noted that while the description below relates to use of the system in a broadcast system such as a CATV system as an example, it could also be used with a dial up system such as pay-per-view television or other program system. In this case once a subscriber dials a particular telephone number or enters a request via a CATV upstream link, accessing a head end, the control data is cyclically transmitted or transmitted once or a predetermined number of times therefrom to a terminal connected to the telephone line or to the cable, which stores the cyclically transmitted data. Either with the connection of the local terminal to the television set or to a television decoder/controller, for display on a television set or display on a local LCD display, the menu described above is provided to the user. After selection of the desired appliances or other apparatus to be controlled from a list, the associated control sequence data is transmitted to the remote control in some manner such as by flashing a local light such as an LED on the local control box or a region of the television screen, or the control sequence data is transmitted to the remote control by infrared or other electromagnetic or ultrasonic energy for storage, as described earlier.

It should be noted that while this description relates to a remote control, the invention should be construed as being usable for other purposes, such as the storage of control codes and sequences selected from a displayed menu for wired-in or wireless devices, and which are either manually controlled by local switches or programs, or for direct control by the transmitted sequences. Further, devices which are plugged in directly to the remote control could as easily be programmed via signals received by the remote control in the manner described herein. The above will become clear to a person skilled in the art understanding the description of the preferred embodiment below, which is directed to the automatic programming of a television remote control which is linked by infrared to a decoder/control circuit.

Due to the preferred repetitive and cyclic transmittal of the control sequences from the head end, addressing of the terminals is not required. In the case of an on-demand service (such as for example a public safety device control sequence), addressing of the terminal making the demand can be used for the requested sequence.

BRIEF INTRODUCTION TO THE DRAWINGS

A better understanding of the invention will be obtained by reference to the detailed description below of a preferred embodiment, in conjunction with the following drawings, in which.

DETAILED DESCRIPTION OF PREFERRED EMBODIMENT

Figure 1:
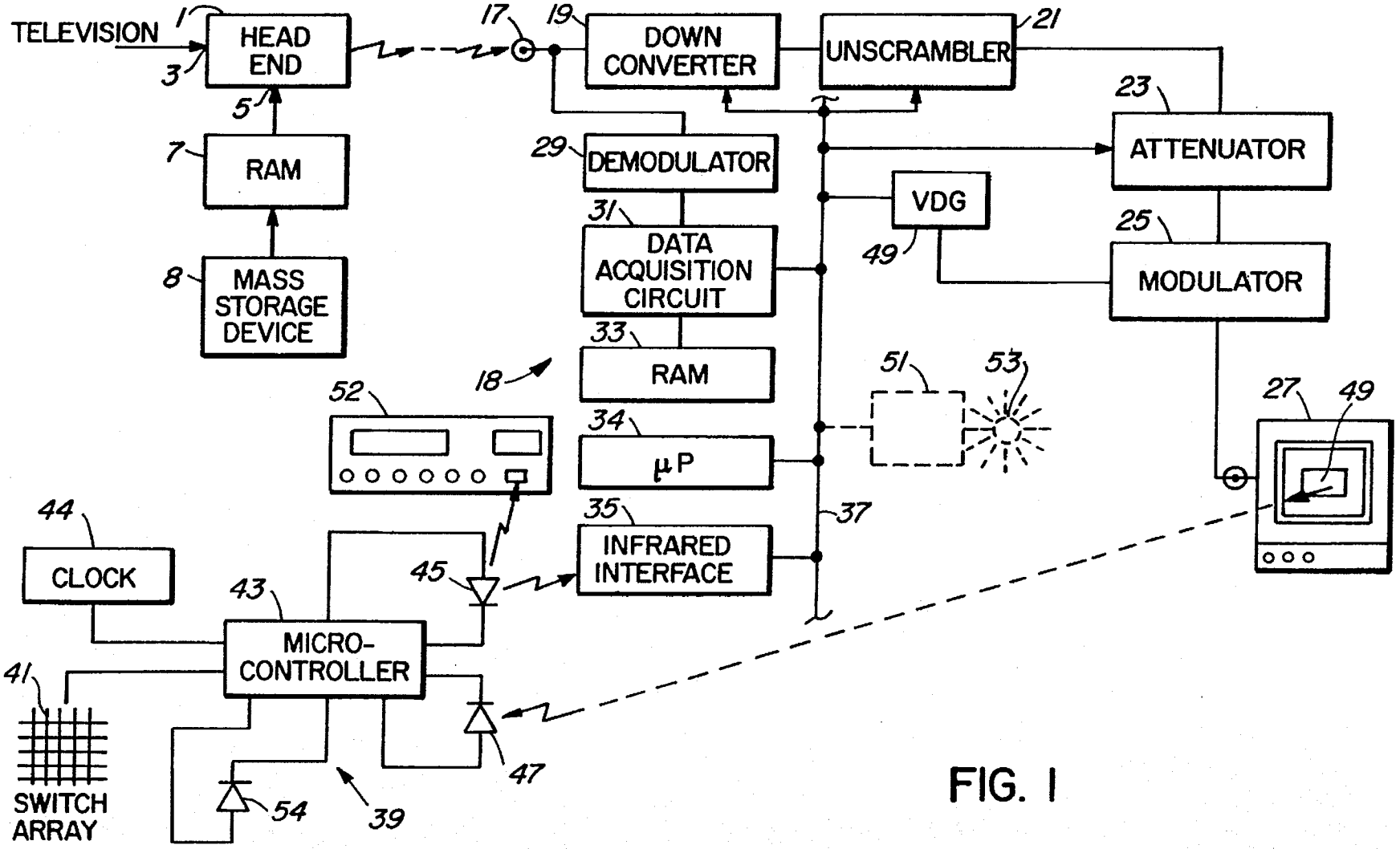
FIG. 1 is a block schematic of a system on which the invention can be implemented.
Figure 2:
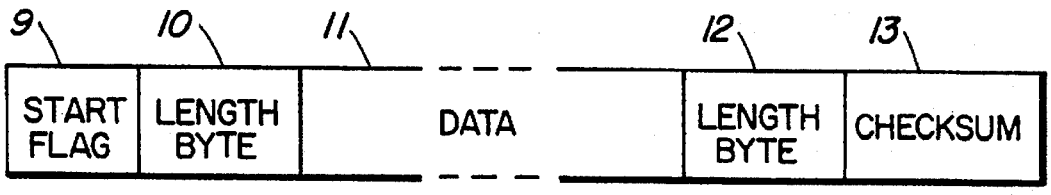
FIG. 2 illustrates a preferred form of data frame transmitted from a TV set to a remote control.

Turning to FIG. 1, a CATV head end 1 receives television program channel inputs at one or plural television inputs 3, and control data to be transmitted at input 5. Data to be transmitted on a preferably cyclic basis, indicated in FIG. 1 as cyclic data, is stored in a random access memory RAM 7 which has been loaded from a mass storage device 8 such as a hard disk drive. The cyclic data can be control sequences for controlling the various functions and programming of various appliances, e.g. various models of television sets, VCRs, audio equipment, etc. as described earlier in this disclosure. The term cyclic data is not intended to be restrictive, as it can be sent for a mass audience at irregular intervals, depending on expected demand or other reasons, or at regular intervals. The term is also not intended to be restrictive as to the number of times the control data is sent in a given period, or in total.

The head end merges the television programs and data, and transmits the programs in a well known manner on various channels. The data can be transmitted during the vertical interval of a predetermined channel, in an FM channel, in a dedicated data channel, in the vertical intervals of plural channels or during a scanning line such as line 21 of a channel, for example. Indeed the data can be transmitted in whatever band may be desired, and using whatever modulation, coding, compression, etc. as is convenient or desirable. However in the preferred embodiment the cyclic data should be read and transmitted repetitively and cyclically, notwithstanding the possibility of restricting the frequency or quantity of repetitions.

Further, while it is preferred that the repetitively transmitted. data should be broadcast, if desired the broadcast signal can be prefixed with an address code whereby only those subscribers which have access to the service can capture the repetitively transmitted data once the address has been recognized.

Indeed, the data can be transmitted to a particularly addressed terminal on request of a subscriber in a direct, rather than cyclically repeated mode.

The head end repetitively reads RAM 7 and transmits the data sequence repetitively in accordance with a known protocol, which sequence is received at input 17 of a converter/controller circuit 18. Normal television signals are passed via down converter 19 and unscrambler 21, if scrambling is used, through attenuator 23 if used, and modulator 25 to the input of a television monitor 27. These elements are controlled by microprocessor 34 as described e.g. in U.S. Pat. No. 4,623,920 issued Nov. 18th, 1986, and invented by Michel Dufresne et al. Data transmitted includes control codes and also user guide instructions, to be shown on the TV screen.

Upon request by the user (to be explained in more detail below), data signals are demodulated in demodulator 29 and are acquired by data acquisition circuit 31, and are stored in random access memory RAM 33. An infrared interface 35 is connected to a bus 37, which interconnects microprocessor 34, data acquisition circuit 31, down converter 19, unscrambler 21 and attenuator 23.

A remote control 39 is comprised of a switch array 41 which is connected to a microcontroller 43 which contains static RAM and a timer. A suitable microcontroller is available from NEC Corporation under Part No. μPD17204. An infrared light emitting diode LED 45 and light detecting diode 47 are connected to microcontroller 43.

When the user wishes to teach the remote control, a "teach" switch of switch array 41 is depressed, which causes microcontroller 43 to cause LED 45 to flash a command sequence to infrared interface 35. This is detected by microprocessor 34, which readies the terminal to acquire the control sequence data, menu and instructions transmitted from the head end. The repetitively transmitted data is demodulated in demodulator 29, is acquired by data acquisition circuit 31 and is stored in RAM 33. Control data stored in RAM 33 by a bus 37 and data acquisition circuit 31. It commands a video display generator (VDG) 49 which is also connected to the bus to generate the characters of an invitation to follow further instructions which is displayed, the instructions, and a menu of various appliances (or programs to be recorded), and applies the characters to modulator 25, which presents them to television monitor 27 in a form for display. The menu of various appliances (or programs) is thus presented to the user.

The user views the screen and selects an appliance (or a program to be recorded) from the menu list, e.g. by closing a switch in switch array 41 corresponding to the menu selection, which sends a command from LED 45 to infrared interface 35. Microprocessor 34 detects the command data from interface 35 and accesses RAM 33 at an address which is designated by the menu item number. The teaching data stored in RAM 33 for the selected appliance is retrieved and passes through video display generator 49, modulating modulator 25. This data preferably causes a central white rectangle 49 to appear on the display of the television monitor 27, and causes it to flash off and on (black and white) in accordance with the stored data sequence.

The remote control having been brought near the display of a television monitor 27, the flashing of the rectangle 49 is received in light detector diode 47. This is converted to data by microcontroller 43 which loads the microcontroller memory. It should be noted that one way to load the memory is to fill it from an initialized address, and another is to load the data at memory locations specific to functions, and which can be designated by part of the data transmitted to it by the flashing of the rectangle. After all codes are sent, a light indicator LED 54 in the remote control is caused to flash, inviting the user to continue following instructions displayed on the TV screen, and serves as a confirmation that the data has been properly received. The user must now take the remote control away from the TV screen. LED 54 can flash in a particular color recognizable as a confirmation by the user, if desired.

The user can then close another switch in the array 41, indicating completion of the sequence, or can operate the switch requesting the menu to be displayed again. In the latter case the entire sequence is repeated, and the data relating to another appliance as selected from the menu is flashed on the television screen, received by the remote control and is stored at memory locations that may be accessed by other switches of array 41 or by the same switches but having a second function. Control data relating to several appliances, up to the memory and key capacities of the remote control can thus be stored.

It should be noted that the flashing rectangle can be any useful shape, and indeed could constitute the entire display of the television monitor. Furthermore, rather than a white flashing rectangle, which is preferred because it is considered to be broad spectrum and thereby more certainly detected by light detector diode 47, instead it could be some other specific color, such as red, etc. Indeed, if desired, different colors could be used for different appliances or purposes.

Alternatively, rather than flashing the display of a television monitor, a separate light controller 51 can be used to flash a light 53 for reception by light detector diode 47. Indeed, rather than a light 53, some other mode of transmission such as a radio signal could be used to transmit the data to remote control 39.

For example the entire sequence stored in RAM 33 could be transmitted (e.g. flashed), and only that data which is pertinent to the various selected appliances would be stored in the microcontroller 43 memory at various locations accessible by predetermined ones of the switches. In this case the data to be stored would pass through a digital filter transmitted at the beginning of the sequence or otherwise established at the remote control which designates which of the appliance data of all the appliance data transmitted (flashed) from monitor 27, etc. is stored in the remote control. The filter data can be sent by a prefix byte or bytes from monitor 27 or light 53, etc.

It should also be noted that it is contemplated that rather than a single menu selection offered to the user for various appliances, instead multiple submenus could be offered to allow for selection of specific remote controllable features or to accommodate listing of a large number of appliances.

In accordance with another mode of operation, in case the user does not know what makes and models of the appliances he has to program, the system could download all of the "on" and "off" control codes into the remote control. The remote control then scans through all of the codes in sequence, that is provide the "on" and "off" codes sequentially by flashing an LED for each appliance at a time in sequence. When a code is flashed, it is detected by an appliance, and it is turned on and then off. The user notes the appliance turning on and off, and after it does so, presses an acknowledgment switch in array 41, such as its on-off control button. The function for that appliance is then stored for use by the user. If other functions are desired, the user can close another switch in array 41 and the remote control transmits a code to infrared interface 35 from the remote control, which indicates to the microprocessor 34 that the code for the particular appliance should be sent. The stored control data in RAM 33 is then transmitted to the remote control by flashing the entire sequence in a manner as described above. Alternatively, once the acknowledgment has been sent, the complete control sequence data relating to control of that appliance could already have been stored in the memory of microcontroller 43 if the on and off codes are prefixed and/or suffixed by the control data, and at least temporarily stored in the remote control until the acknowledgment, following which it is permanently stored.

As the control data stored in remote control 39 is programmable with data sent from the head end, the learning remote control can be totally reprogrammed as desired, for example, to implement improvements in the supplier/user interface, to facilitate the implementation of new services, to access new systems, such as home automation, or to download an encryption key. In the latter case, this facilitates encryption of the infrared transmission signal, which can be changed at desired time intervals. The encryption key can be used for high security, such as for use of a personal identification number (PIN) for home banking services, etc.

Figure 3:
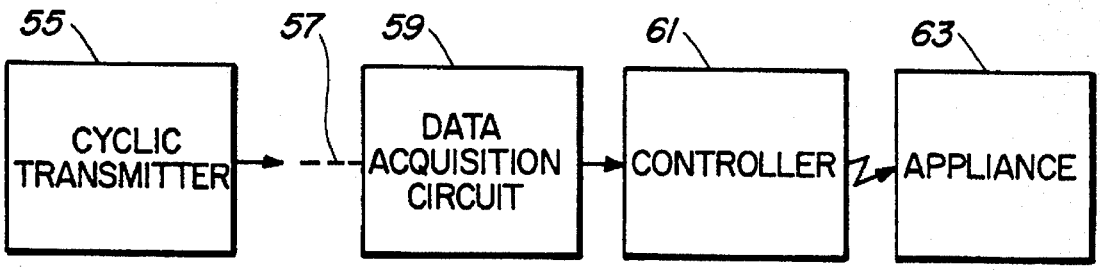
FIG. 3 is a more general block schematic of a system on which the invention can be implemented.

As illustrated in FIG. 3 the basic elements required for operation of the invention is a transmitter 55 for storing and transmitting data on a preferably repetitive, cyclic basis to subscriber stations via a transmission medium 57. Each subscriber station is comprised of a data acquisition circuit 59, which in the embodiment of FIG. 3 should be construed in broader terms than the data acquisition circuit 31 of FIG. 1, and a controller 61 for controlling or programming one or plural appliances 63. After cyclic transmission of control sequences, the data acquisition circuit stores the cyclically transmitted data, and controller 61 accesses that particular data which is specific to the appliances which it is to control. The controller 61 is then used independently to control the specific appliances used by the user. As noted above, the appliances can be of a wide range, and need not be restricted to those used in the home of the user, but may be usable to control remote control security locks, automotive and/or home alarm systems, control of a VCR to record related programs, etc.

The control codes requested could as well be transmitted to a directly addressed user terminal, the request being made by telephone or by an upstream signal to a head end, and thus not be transmitted cyclically.

With reference again to FIG. 1, for control of a VCR 52, the control sequences stored in the user terminal 18 related to a selected program or programs can be transmitted from the terminal 18 to the remote control 39 to be recorded, as described above, for storage in the remote control. At a later time, prior to the beginning of a program to be recorded, the remote control 39 is placed where LED 45 is facing VCR 52 (in particular a receiving sensor 52' thereof). Under control of the storage sequences, the VCR is controlled by transmission of a signal from LED 45 to sensor 52', to record a selected program. To enable this function, microcontroller 43 is connected to a real time clock 44 to determine the actual time for start and stop control of the VCR.

Alternatively the terminal 18 is connected to a real time clock. Prior to the beginning of a program to be recorded, the remote control is placed where it can receive signals transmitted from terminal 18 and at the same time transmit signals to sensor 52', as described above. At the appropriate time, the control signals are transmitted from terminal 18 and remote control 39 receives them and immediately retransmits the control signals to sensor 52' of VCR 52, controlling it to record the selected program.

The system has been found to be easy to use and both avoids the requirement for a user to program a learning remote control from individual remote controls for various appliances, and allows updating of the control codes in a single remote control as the user acquires more or different appliances and to add services to the system.

A person understanding this invention may now conceive of alternative structures and embodiments or variations of the above. All of those which fall within the scope of the claims appended hereto are considered to be part of the present invention.

We claim:

1. A method of programming a remote control comprising:

(a) storing in a memory, data for control of a population of appliances, said data being sufficient to allow a remote control to remotely control functions of any of the population of appliances;

(b) selecting which appliances are to be controlled by the remote control, (c) transmitting to the remote control data for control of the selected appliances;

(d) storing said transmitted data in said remote control;

whereby the remote control is programmed to control the selected appliances, (e) said memory being at a central location, and said data is transmitted to a user terminal for acquisition by said remote control, (f) the data is acquired by the remote control by flashing a code using electromagnetic energy at the user terminal corresponding to said data for control of said appliances on a display, and (g) pointing said remote control at a display for reception and thus acquisition of said data.

2. A method as defined in claim 1, including storing said data locally in said terminal prior to flashing said code.

3. A method as defined in claim 2 including displaying on said display descriptions of a plurality of models of appliances for selection thereof by said user, selecting a model by signalling from the remote control, and flashing particular control codes corresponding to data related to the selected appliance models and functions thereof on said display, detecting said flashing in the remote control, and storing control codes corresponding thereto in the remote control for later access thereof by the user for control of local appliances.

4. A method for programming an appliance control apparatus comprising repetitively and cyclically transmitting control code for a population of appliances from a central location, receiving said control codes, the transmitting step being comprised of broadcasting said control codes, storing all of the control codes for said population of appliances at the control apparatus, indicating to a user the identity of appliances that may be controlled by means of a remote appliance control means, selectively particular ones of said appliances in response to said indication, then storing only those control codes corresponding to said selected particular appliances in said remote appliance control means, in which the indicating step is effected by flashing a light to said remote appliance control means in accordance with said control codes, and in which the storing means is effected by storing data signals corresponding to the flashes of light in memory locations of said remote appliance control means addressable by predetermined key switches of said remote appliance control means, whereby said codes stored at said memory locations can be accessed by means of said switches and local appliances control codes generated thereby for controlling said local appliances.

5. A method of defined in claim 4 in which said flashes of light are generated by applying modulated representations of said control codes to a television monitor and flashing a display of said monitor.

6. A method as defined in claim 5 including flashing a restricted area on the screen of said monitor.

7. A method as defined in claim 4 which the flashes of light are generated by applying modulated representations of said control codes to a light emitting diode, and flashing said diode.

8. A method of programming an appliance control apparatus comprising repetitively and cyclically transmitting control codes for a population of appliances from a central location, receiving said control codes and storing at least those control codes required to control local appliances at the control apparatus, the transmitting step being comprised of broadcasting said control codes, at least some of the control codes are for control of a VCR to record a program during a predetermined period on a predetermined channel, further including controlling said VCR using said control codes for control of said VCR, and including displaying to a user on a display a list of programs that may be automatically recorded by means of a control means, selecting particular programs from the list, then storing control codes for control of said VCR in the control means corresponding to the selected programs.

9. A method as defined in claim 8 in which said control means is comprised of positioning a remote control in receiving range of said control apparatus and in transmitting range of said VCR, transmitting said control codes for control of said VCR to the remote control from the control apparatus and retranslating said control codes for control of said VCR from the remote control to the VCR to control recording of at least one selected program.

10. A method as defined in claim 9 in which said transmitted control codes for control of the VCR are stored in the remote control, and in which the step of positioning the remote control in transmitting range of said VCR is conducted a period of time after the control codes have been transmitted, but prior to a start time of said one selected program.

11. A method of programming and operating a remote control comprising:

(a) transmitting from a central location control codes for recording of at least one program by at least one VCR, (b) acquiring and storing said control codes in a user terminal, (c) presenting on a display screen associated with the user terminal a list of programs for which the control codes have been stored, (d) selecting a program from the list by means of a signal from a remote control to the user terminal, (e) transmitting particular control codes from those stored in the user terminal, relating to the selected program, from the user terminal to the remote control, and (f) automatically controlling the VCR from the remote control using the particular control codes, to record the selected program.

12. A method as defined in claim 11, including storing the particular control codes in the remote control and automatically controlling the VCR to record the selected program during a selected interval of the program, from the stored control codes.

13. A method as defined in claim 12, including transmitting the particular control codes from the user terminal to the remote control and immediately retransmitting the particular control codes from the remote control to the VCR to control the VCR to record the selected program during a selected interval of the program.

14. A method of programming and operating a remote control comprising:

(a) repetitively and cyclically transmitting control code for a population of appliances from a central location, (b) transmitting from a remote control to a user terminal a command for the user terminal to acquire said control codes, (c) acquiring and storing said control codes in the user terminal, (d) presenting on a display screen associated with the user terminal a list of appliances for which the control sequences have been stored, (e) selecting an appliance from the list by means of a signal from the remote control to the user terminal, (f) transmitting particular control codes from those stored in the user terminal, relating to the selected appliance, from the user terminal to the remote control, and storing the particular control codes in the remote control, and (g) controlling the selected appliance from the remote control using the particular control codes, in which the particular control codes are control codes designating the on time, off time, and channel of a particular VCR for a particular program shown on said list.

15. A method of programming and operating a remote control comprising:

(a) repetitively and cyclically transmitting control codes for a population of appliances from a central location, (b) transmitting from a remote control to a user terminal a command for the user terminal to acquire said control codes, (c) acquiring and storing said control codes in the user terminal, (d) presenting on a display screen associated with the user terminal a list of appliances for which the control sequences have been stored, (e) selecting an appliance from the list by means of a signal from the remote control to the user terminal, (f) transmitting particular control codes from those stored in the user terminal, relating to the selected appliance, from the user terminal to the remote control, and storing the particular control codes in the remote control, and (g) controlling the selected appliance from the remote control using the particular control codes, in which a guide of programming instructions transmitted to the user terminal and stored in the user terminal is displayed on said display prior to presentation of said list of said appliances.

16. A method as defined in claim 15, including repeating steps (d)–(g) for additional appliances, and controlling a plurality of appliances from the remote control using stored particular control codes stored therein.

17. A method as defined in claim 15, including selecting plural appliances from the list, and transmitting control codes for all of the selected plural appliances from the user terminal to the remote control in one sequence for storage in the remote control, whereby all of the selected appliances may be controlled by the remote control from said stored sequence of control codes.

18. A method of programming an appliance control apparatus comprising providing an identification of equipment to be controlled to a service provider, and transmitting by said service provider from a head end control codes for said equipment via a transmission medium, said control codes being addressed to a user terminal, receiving said control codes from the transmission medium in the user terminal and storing said control codes for invoking by a subscriber in controlling said equipment, locally storing said control codes in a user remote control, and at least temporarily storing said control codes in a terminal memory and wireless transmitting said control code from said terminal to the remote control on command from the remote control, in which said wireless transmitting is effected by one of infrared light, a flashing light emitting diode and a flashing television display screen.

19. A method for programming a remote control comprising:

(a) storing in a memory, data for control of a population of appliances, said data being sufficient to allow a remote control to remotely control functions of any of the population of appliances;

(b) selecting which appliances are to be controlled by the remote control;

(c) transmitting to the remote control data for control of the selected appliances;

(d) storing said transmitted data in said remote control;

whereby the remote control is programmed to control the selected appliances, (e) in which data transmitted and stored in the remote control includes an encryption key, and (f) controlling at least one appliance by transmitting an encrypted ultrasonic or electromagnetic energy signal from the remote control to said at least one appliance for decoding of said signal and control of said at least one appliance by the decoded signal.

20. A method as defined in claim 19 including transmitting either said encrypted signal or an unencrypted signal to said at least one appliance from the remote control depending on whether the appliance is required to operate a secure function or a non-secure function.

21. A method as defined in claim 19 in which the encrypted signal contains a representation of a PIN number.

22. A method of programming a remote control comprising:

(a) storing in a memory, data for control of a population of appliances, said data being sufficient to allow a remote control to remotely control functions of any of the population of appliances;

(b) selecting which appliances are to be controlled by the remote control;

(c) transmitting to the remote control data for control of the selected appliances;

(d) storing said transmitted data in said remote control;

whereby the remote control is programmed to control the selected appliances, (e) in which the data transmitted and stored in the remote control is substituted for a program already stored therein, whereby the remote control is completely reprogrammed.

23. A method as defined in claim 22 in which said data is repetitively and cyclically broadcast from the central location, appliances of said population being different models of different kinds of appliances and equipment which use different control codes from each other.

24. A method as defined in claim 22 wherein said transmission to a user terminal is via wireless broadcast.

25. A method as defined in claim 22 wherein said transmission to a user terminal is via a CATV network.

26. A method as defined in claim 22 in which at least some of the control codes are for control of a VCR to record a program during a predetermined period on a predetermined channel, and further including controlling said VCR using said control codes for control of a VCR.

27. A method as defined in claim 22 in which said substitute program includes an encryption key.

28. A method as defined in claim 22 in which the control codes are broadcast over one of a CATV network, a direct satellite to home broadcast, a local television station, a fiber optic network and a dial up computer-accessible network.

* * * * *